US008431308B2

(12) United States Patent
Pang et al.

(10) Patent No.: US 8,431,308 B2
(45) Date of Patent: Apr. 30, 2013

(54) TONER FOR DEVELOPING ELECTROSTATIC IMAGE AND METHOD OF PREPARING THE SAME

(75) Inventors: Kyeong Pang, Suwon-si (KR); Jae-hwan Kim, Seoul (KR); Jin-mo Hong, Yongin-si (KR); Yo-da Shin, Suwon-si (KR); Su-bum Park, Daeou (KR); Jeong-hyun Lee, Suwon-si (KR); Mi-rim Cho, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 217 days.

(21) Appl. No.: 12/923,966

(22) Filed: Oct. 18, 2010

(65) Prior Publication Data

US 2011/0183252 A1 Jul. 28, 2011

(30) Foreign Application Priority Data

Jan. 22, 2010 (KR) ..... 10-2010-0006046

(51) Int. Cl.
*G03G 9/00* (2006.01)

(52) U.S. Cl.
USPC ..... 430/110.2; 430/109.1; 430/109.4

(58) Field of Classification Search ..... 430/109.1, 430/109.4, 110.2
See application file for complete search history.

(56) References Cited

U.S. PATENT DOCUMENTS

| | | | | |
|---|---|---|---|---|
| 6,617,091 | B2 | 9/2003 | Nishimori et al. | |
| 7,695,884 | B2 * | 4/2010 | Vanbesien et al. | 430/110.2 |
| 2006/0078815 | A1 * | 4/2006 | Ito et al. | 430/109.4 |
| 2006/0204880 | A1 * | 9/2006 | Mizutani et al. | 430/109.4 |
| 2006/0292477 | A1 * | 12/2006 | Daimon et al. | 430/109.4 |
| 2007/0048647 | A1 * | 3/2007 | Daimon et al. | 430/110.2 |
| 2009/0111038 | A1 * | 4/2009 | Shin et al. | 430/48 |
| 2009/0155700 | A1 * | 6/2009 | Pang et al. | 430/48 |
| 2009/0220882 | A1 * | 9/2009 | Zhou et al. | 430/109.3 |

* cited by examiner

*Primary Examiner* — Stewart Fraser
(74) *Attorney, Agent, or Firm* — Staas & Halsey LLP

(57) ABSTRACT

Toner for developing an electrostatic image, which satisfies charging stability, low-temperature fixability, high-temperature storage characteristics, and durability with respect to an environment up to a predetermined level or above, and a method of preparing the toner. The toner includes: a core layer including a first binder resin, a colorant, and a releasing agent; and a shell layer covering the core layer and including a second binder resin, wherein the first binder resin includes about 70 wt % or above of amorphous polyester resin and about 30 wt % or below of crystalline polyester resin, the second binder resin includes an amorphous polyester resin, and a melting temperature (Tm(C)) of the crystalline polyester resin, a melting temperature (Tm(W)) of the releasing agent, and a melting point (Tm(T)) of the toner satisfy the following conditions: $-20° C. \leqq Tm(W)-Tm(C) \leqq 20° C.$; and $0° C. < Tm(C)-Tm(T) \leqq 10° C.$

7 Claims, 2 Drawing Sheets

TONER FOR DEVELOPING ELECTROSTATIC IMAGE AND METHOD OF PREPARING THE SAME

CROSS-REFERENCE TO RELATED APPLICATIONS

This application claims the benefit of Korean Patent Application No. 10-2010-0006046, filed on Jan. 22, 2010, in the Korean Intellectual Property Office, the disclosure of which is incorporated herein in its entirety by reference.

BACKGROUND

1. Field

The present embodiments relate to toner for developing an electrostatic image and a method of preparing the same.

2. Description of the Related Art

Methods of preparing toner particles suitable for an electrophotographic process and an electrostatic image recording process may be largely classified into a pulverization process and a polymerization process.

Conventionally, toners used in an image-forming apparatus are mostly obtained by a pulverization process. However, in the pulverization process, it is difficult to precisely control the particle size, geometric size distribution, and the structure of toner, and thus, it is difficult to separately control the major characteristics of toner, such as charging characteristics, fixability, flowability, and storage characteristics.

Recently, the use of polymerization toner has increased due to a simpler manufacturing process, which does not require sorting particles and due also to the ease of controlling the size of the particles. When toner is prepared through the polymerization process, polymerization toner having a desired particle size and particle size distribution can be obtained without pulverizing or sorting. Since toner prepared according to the polymerization process has a smaller particle size and narrower geometric size distribution than toner prepared according to the pulverization process, an image-forming apparatus using the toner prepared according to the polymerization process has high charging and transferring efficiency, excellent dot and line reproducibility, low toner consumption, and high image quality. Recently, interest in the environment has increased when manufacturing toner according to the polymerization process. Accordingly, there is continuous interest in increasing durability of a system element and low-temperature fixation, which is advantageous in reducing energy consumption, is drawing attention.

U.S. Pat. No. 6,617,091 discloses a toner particle, wherein a resin layer (shell) is formed on a surface of a colorant particle (core particle) containing a resin and a colorant, to provide polymerization toner that does not change image concentration, fog an image, or change a color of the image resulting from a change of charging and developing properties, even when the amount of colorant existing on a particle surface is small and the polymerization toner is provided for a long time under high humidity. According to such polymerization toner, the uniformity of charging may be somewhat increased by suppressing exposure of a surface of a pigment. However, for example, when the polymerization toner contains lots of wax, high-temperature storage characteristics and flowability of the polymerization toner may deteriorate due to a plasticizing effect according to compatibility between a low molecular portion of the wax and the resin. A method of encapsulating a surface of a binder resin having a low glass transition temperature with a binder resin having a somewhat high glass transition temperature has also been suggested for low-temperature fixation. According to such a method, the low-temperature fixation may be achieved but high-temperature storage characteristics may not be satisfactory.

SUMMARY

The present embodiments provide toner for developing an electrostatic image, which satisfies charging stability, low-temperature fixability, high-temperature storage characteristics, and durability with respect to an environment up to a predetermined level or above.

The embodiments also provide a method of preparing the toner.

The present embodiments also provide a toner supplying unit and an image-forming apparatus employing the toner.

According to an embodiment, there is provided toner for developing an electrostatic image, including: a core layer including a first binder resin, a colorant, and a releasing agent; and a shell layer covering the core layer and including a second binder resin, wherein the first binder resin includes about 70 wt % or above of amorphous polyester resin and about 30 wt % or below of crystalline polyester resin, the second binder resin includes an amorphous polyester resin, and a melting temperature (Tm(C)) of the crystalline polyester resin, a melting temperature (Tm(W)) of the releasing agent, and a melting point (Tm(T)) of the toner satisfying Conditions 1 and 2 below:

$$-20^\circ\text{ C.} \leqq Tm(W)-Tm(C) \leqq 20^\circ\text{ C.} \quad (1), \text{ and}$$

$$0^\circ\text{ C.} < Tm(C)-Tm(T) \leqq 10^\circ\text{ C.} \quad (2).$$

According to another aspect, there is provided a method of preparing toner for developing an electrostatic image, the method including: preparing a mixed solution by mixing a latex of a first binder resin, a colorant, and a releasing agent, wherein the first binder resin includes about 70 wt % or above of amorphous polyester resin, and about 30 wt % or below of crystalline polyester resin; forming a core particle including the first binder resin, the colorant, and the releasing agent by adding an aggregating agent to the mixed solution; adding a latex of the second binder to a dispersion of the core particle to coat the second binder resin on a surface of the core particle, forming a shell layer on the surface of the core particle and growing the core particle size, wherein the second binder resin comprises an amorphous polyester resin; and heating the dispersion to control the shape of a toner particle comprising the core layer and the shell layer, wherein a melting temperature (Tm(C)) of the crystalline polyester resin, a melting temperature (Tm(W)) of the releasing agent, and a melting temperature (Tm(T)) of the toner satisfying Conditions 1 and 2 below:

$$-20^\circ\text{ C.} \leqq Tm(W)-Tm(C) \leqq 20^\circ\text{ C.} \quad (1), \text{ and}$$

$$0^\circ\text{ C.} < Tm(C)-Tm(T) \leqq 10^\circ\text{ C.} \quad (2).$$

A glass transition temperature (Tg(A)) of the amorphous polyester resin of the core layer and a glass transition temperature Tg(T)) of the toner may satisfy Condition 3 below:

$$0^\circ\text{ C.} < Tg(A)-Tg(T) \leqq 10^\circ\text{ C.} \quad (3).$$

The melting temperature (Tm(C)) of the crystalline polyester resin and the melting point (Tm(W)) of the releasing agent may satisfy Conditions 4 and 5 below:

$$60^\circ\text{ C.} < Tm(C) < 100^\circ\text{ C.} \quad (4), \text{ and}$$

$$60^\circ\text{ C.} < Tm(W) < 100^\circ\text{ C.} \quad (5).$$

An acid value ($RA_{av}$) of the releasing agent, an acid value ($APE1_{av}$) of the amorphous polyester resin of the core layer, an acid value ($CPE_{av}$) of the crystalline polyester resin, and an acid value ($APE2_{av}$) of the amorphous polyester resin of the shell layer may satisfy Conditions 6 through 8 below:

$$RA_{av} \leqq APE1_{av} \leqq CPE_{av} \leqq APE2_{av} \quad (6),$$

$$CPE_{av} - APE1_{av} \leqq 5 \text{ through } 10 \quad (7), \text{ and}$$

$$APE2_{av} - CPE_{av} \leqq 5 \text{ through } 10 \quad (8).$$

The toner may included iron (Fe), silicon (Si), and zinc (Zn), the amounts of Si and Fe may be each independently from about 3 to about 1000 ppm, a mole ratio (Si/Fe) of Si and Fe may be from about 0.1 to about 5, and a [Si]/[Fe] ratio and a [Zn]/[Fe] ratio may satisfy Conditions 9 and 10 below when [Si], [Zn], and [Fe] respectively may denote intensities of Si, Zn, and Fe according to X-ray fluorescence spectrometry:

$$0.0005 \leqq [Si]/[Fe] \leqq 0.05 \quad (9), \text{ and}$$

$$0.0005 \leqq [Zn]/[Fe] \leqq 0.5 \quad (10).$$

A volume average diameter of the toner may be in the range from about 3 to about 9 μm.

An average circularity of the toner may be in the range from about 0.940 to about 0.980.

A volume average geometric size distribution coefficient (GSDv) of the toner may be about 1.3 or less, and a number average geometric size distribution coefficient GSDp of the toner may be about 1.25 or less.

The releasing agent may be one selected from the group consisting of polyethylene-based wax, polypropylene-based wax, silicone wax, paraffin-based wax, ester-based wax, carnauba wax, and metallocene wax.

The aggregating agent may include a silicon and iron containing metal salt. The aggregating agent may include polysilicate iron.

According to another aspect, there is provided a toner supplying unit including: a toner tank in which toner may be stored; a supplying part protruding from an inner surface of the toner tank to externally supply toner from the toner tank; and a toner-agitating member rotatably disposed inside the toner tank to agitate toner in the inner space of the toner tank including a space above a top surface of the supplying part, wherein the toner is the toner.

BRIEF DESCRIPTION OF THE DRAWINGS

The above and other features and advantages of the present embodiments will become more apparent by describing in detail exemplary embodiments thereof with reference to the attached drawings in which.

DETAILED DESCRIPTION

Figure 1:
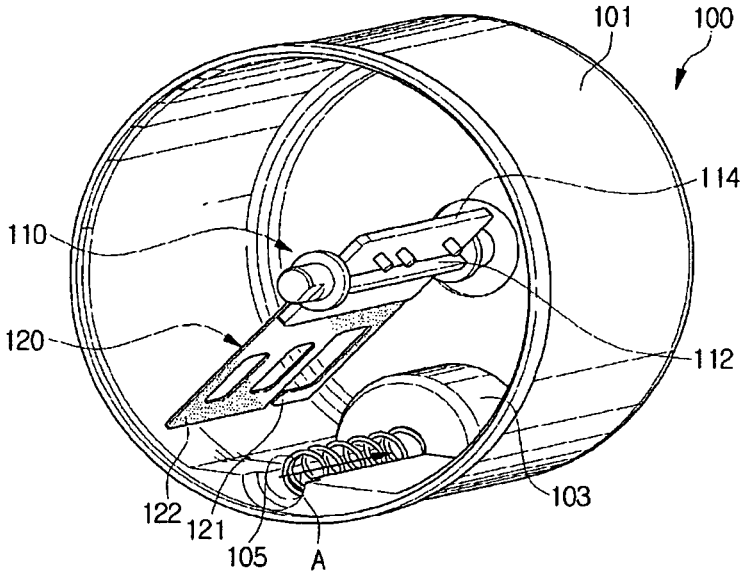
FIG. 1 is a perspective view of a toner supplying unit according to an embodiment.

The present embodiments will now be described more fully with reference to the accompanying drawings, in which exemplary embodiments of the present general inventive concept are shown.

Toner for developing an electrostatic image according to an embodiment minimizes compatibilization according to an ester exchange reaction between crystalline polyester and amorphous polyester by adjusting the properties and amounts of the crystalline polyester having sharp melting characteristics, the amorphous polyester having low-temperature fixability, and a releasing agent, thereby maintaining the sharp melting characteristics of the crystalline polyester and a high glass transition temperature (Tg) of the amorphous polyester. Accordingly, the toner may satisfy low-temperature fixability, charging stability, high-temperature storage characteristics, and durability with respect to an environment up to a predetermined level or above.

In detail, the toner includes: a core layer including a first binder resin, a colorant, and a releasing agent; and a shell layer covering the core layer and including a second binder resin, wherein the first binder resin of the core layer includes about 70 wt % or above of amorphous polyester resin and about 30 wt % or below of a crystalline polyester resin, the second binder resin includes an amorphous polyester resin, and the melting temperature (Tm(C)) of the crystalline polyester resin, the melting point (Tm(W)) of the releasing agent, and the melting point (Tm(T)) of the toner satisfy Conditions 1 and 2 below:

$$-20° \text{ C.} \leqq Tm(W) - Tm(C) \leqq 20° \text{ C.} \quad (1) \text{ and}$$

$$0° \text{ C.} < Tm(C) - Tm(T) \leqq 10° \text{ C.} \quad (2).$$

The glass transition temperature (Tg(A)) of the amorphous polyester resin of the core layer and the glass transition temperature (Tg(T)) of the toner may satisfy Condition 3 below:

$$0° \text{ C.} < Tg(A) - Tg(T) \leqq 10° \text{ C.} \quad (3).$$

The Tm(C) of the crystalline polyester resin and the Tm(W) of the releasing agent may satisfy Conditions 4 and 5 below:

$$60° \text{ C.} < Tm(C) < 100° \text{ C.} \quad (4), \text{ and}$$

$$60° \text{ C.} < Tm(W) < 100° \text{ C.} \quad (5).$$

The toner has a core-shell structure including the core layer and the shell layer as described above.

The first binder resin of the core layer may include about 70 wt % or greater, for example, about 70 wt % to about 99 wt % or about 80 wt % to about 97 wt % of the amorphous polyester resin based on the total binder weight of the core layer, and about 30 wt % or less, for example, about 1 wt % to about 30 wt % or about 3 wt % to about 20 wt % of the crystalline polyester resin based on the total binder weight of the core layer. A polyester resin is advantageous in excellently reproducing a color. When the first binder resin includes about 70 wt % or greater of amorphous polyester resin and about 30 wt % or less of crystalline polyester resin based on the total binder weight, the strength of the toner may be maintained, and the toner may be fixed at low-temperatures. In addition, an image quality defect caused by the internal contamination of an image-forming system may be prevented, and high-temperature storage characteristics and charging characteristics of the toner may be improved.

The crystalline polyester resin is a polyester resin that shows a sharp endothermic peak representing fusion or melting of crystallites in a differential scanning calorimetry (DSC) curve. For example, a full width at half maximum (FWHM) of the endothermic peak of the crystalline polyester resin may be within 15° C., when a temperature increasing rate is 10° C. per minute during a DSC experiment. The crystalline polyester resin is used to improve image gloss and low-temperature fixability of the toner. The amorphous polyester resin is a polyester resin that does not show a sharp endothermic peak representing fusion or melting of crystallites in a DSC curve. For example, an endothermic amount of the amorphous polyester resin may show a so-called "base line shift" phenomenon or a FWHM of the endothermic peak of the amorphous polyester resin may be greater than 15° C., when a temperature increasing rate is 10° C. per minute during the DSC experiment. The crystalline polyester resin may have a melting temperature (Tm) of about 70° C. to about 100° C., for example about 70° C. to about 90° C. If the melting temperature of the crystalline polyester resin is within the range of about 70° C. to about 100° C., toner particles may be suppressed from aggregating, preservation characteristics of a fixed image may be improved, and low-temperature fixability may be improved. The amorphous polyester resin may have a glass transition temperature (Tg) of about 50° C. to about 75° C., for example, about 60° C. to about 70° C.

When the crystalline polyester resin is added to the amorphous polyester resin, the toner has high fixability near a melting temperature of the crystalline polyester resin according to sharp melting characteristics of the crystalline polyester resin, i.e., according to an effect of remarkable reduction of viscosity as the crystalline polyester resin quickly melts at a narrow temperature range near the melting temperature. When a crystalline polyester resin having a relatively low melting point (equal to or greater than Tg of the amorphous polyester resin) is used within a range of maintaining durability and high-temperature storage characteristics of the toner, the toner may have quick and high fixability at a low-temperature. In other words, the high Tg of the amorphous polyester resin is maintained by suitably mixing the crystalline polyester resin and the amorphous polyester resin, and the toner has a remarkably reduced viscosity at a fixing temperature according to the sharp melting characteristics of the crystalline polyester resin. Thus, high-temperature storage characteristics are maintained while obtaining low-temperature fixability. However, in order to effectively realize such characteristics, the compatibility of the crystalline and amorphous polyester resins is necessarily controlled.

Generally, when two types of polyester are mixed together by melting, an ester exchange reaction occurs between ester groups of the two types of polyester, and thus the mixture of two types of polyester changes to a copolymer form. The copolymer is at first in a block copolymer form, but as compatibilization proceeds, the copolymer gradually changes to a random copolymer form. Accordingly, it is difficult to crystallize due to the irregularity of a polymer chain, and a plasticization effect, wherein a melting temperature and a glass transition temperature of the mixture or the copolymer are shifted to a lower temperature side, may occur. Consequently, the durability and storage characteristics of the toner may deteriorate.

The toner according to the embodiments may be prepared by preparing latex (emulsion) of each polyester resin in such a way that the particle size is from about 100 to about 300 nm, and then growing the particle size to be used as the toner through an aggregation and coalescence process after mixing. The aggregation process is performed at Tg of the amorphous polyester resin or below, but the coalescence process is performed at Tg of the amorphous polyester resin and the melting temperature of the crystalline polyester resin or above. Accordingly, each polyester resin maintains a molten state for about 2 to about 3 hours during the coalescence process, and thus the compatibilization inevitably proceeds. Thus, when it is difficult to crystallize due to compatibilization, sharp melting characteristics disappear and thus low-temperature fixability may not be obtained. However, since a proceeding speed of compatibilization depends on compatibility between two polymers, molecular structure design of polyester resins used to prepare toner is considered important. In the toner according to the embodiments, compatibility between a polyester binder resin and a releasing agent is strictly controlled by designing the crystalline polyester resin and the amorphous polyester resin of the core layer according to following conditions such that the melting temperature of the crystalline polyester resin and the Tg of the amorphous polyester resin do not remarkably change after the toner is prepared, thereby satisfactorily maintaining high-temperature storage characteristics, low-temperature fixability, and high gloss of the toner.

In detail, the Tm(C) of the crystalline polyester resin, the Tm(W) of the releasing agent, and the Tm(T) of the toner satisfy Conditions 1 and 2 below:

$$-20^\circ\text{ C.} \leqq Tm(W)-Tm(C) \leqq 20^\circ\text{ C.} \quad (1), \text{ and}$$

$$0^\circ\text{ C.} < Tm(C)-Tm(T) \leqq 10^\circ\text{ C.} \quad (2).$$

The releasing agent and the crystalline polyester resin exist in the core layer of the toner by forming a co-crystal. When the melting temperatures of the releasing agent and the crystalline polyester resin satisfy Condition 1, the releasing agent and the crystalline polyester resin easily form a co-crystal, and thus a uniform fixed image may be easily obtained.

When the Tm(C) of the crystalline polyester resin and the Tm(T) of the toner satisfy Condition 2 above and thus the difference between them is maintained to be 10° C. or less, the crystalline polyester resin having a less amount forms a discontinuous island phase including a plurality of islands, and amorphous polyester resin having a more amount forms a continuous sea phase since compatibility between the crystalline polyester resin and the amorphous polyester resin is low. Accordingly, the crystalline and amorphous polyester resins exist in a sea-islands structure, wherein a plurality of islands of crystalline polyester resin are distributed in the continuous sea phase of the amorphous polyester resin. When the difference exceeds 10° C. due to compatibilization of the crystalline polyester resin and the amorphous polyester resin after the toner is prepared, the high-temperature storage characteristics of the toner may deteriorate. At the same time, a melting peak area of the crystalline polyester resin may be broadened, and thus the sharp melting characteristics of the crystalline polyester resin may disappear.

The Tg(A) of the amorphous polyester resin of the core layer and the Tg(T) of the toner may satisfy Condition 3 below:

$$0^\circ\text{ C.} < Tg(A)-Tg(T) \leqq 10^\circ\text{ C.} \quad (3).$$

The Tg(A) of the amorphous polyester resin is also decreased as a result of the compatibilization, and the difference between the Tg(A) of the amorphous polyester resin and the Tg(T) of the toner may be maintained to be 10° C. or less. When the difference exceeds 10° C., the high-temperature storage characteristics of the toner may deteriorate.

The Tm(C) of the crystalline polyester resin and the Tm(W) of the releasing agent may satisfy Conditions 4 and 5 below:

$$60^\circ\text{ C.} < Tm(C) < 100^\circ\text{ C.} \quad (4), \text{ and}$$

$$60^\circ\text{ C.} < Tm(W) < 100^\circ\text{ C.} \quad (5).$$

When the Tm(C) and the Tm(W) are within the above ranges, the durability and the fixability of the toner may be maintained up to a satisfactory level.

Also, an acid value ($RA_{av}$) of the releasing agent, an acid value ($APE1_{av}$) of the amorphous polyester resin of the core layer, an acid value ($CPE_{av}$) of the crystalline polyester resin, and an acid value ($APE2_{av}$) of the amorphous polyester resin of the shell layer may satisfy Conditions 6 through 8 below:

$$RA_{av} \leqq APE1_{av} \leqq CPE_{av} \leqq APE2_{av} \quad (6),$$

$$CPE_{av} - APE1_{av} \leqq 5 \text{ through } 10 \quad (7), \text{ and}$$

$$APE2_{av} - CPE_{av} \leqq 5 \text{ through } 10 \quad (8).$$

When Condition 6 is satisfied, the amount of hydrophilic carboxyl group increases toward the direction of the shell layer, and thus the charging stability of the toner may increase.

Polyester resins may be prepared by reacting an aliphatic, an alicyclic, or an aromatic polyvalent carboxylic acid or an alkyl ester thereof with an aliphatic polyhydric alcohol through a direct esterification reaction or ester exchange reaction.

In detail, the crystalline polyester resin may be prepared by reacting an aliphatic polyvalent carboxylic acid having at least C8 (excluding carbon of a carboxyl group), for example, from C8 to C12, in detail, from C9 to C10, with an aliphatic polyhydric alcohol having at least C8, for example, from C8 to C12, in detail, from C10 to C12. For example, the crystalline polyester resin may be obtained by reacting 1,9-nonanediol and 1,10-decane dicarboxylic acid, or 1,9-nonanediol and 1,12-dodecane dicarboxylic acid. If the numbers of carbon atoms for the aliphatic polyvalent carboxylic acid and the aliphatic polyhydric alcohol are within the above ranges, the crystalline polyester resin may have a melting temperature suitable to be used for toner. In addition, such crystalline polyester resin has a higher linearity, and thus has a higher affinity (compatibility) to the amorphous polyester resin.

Polyester resin may be prepared at a polymerization temperature of about 180° C. to about 230° C., in a reaction system under a reduced pressure if required, while water or alcohol produced during condensation reaction is removed.

Examples of a catalyst that may be used to prepare the crystalline polyester resins include, but are not limited to, organometallic compounds, such as organic alkali metal compounds including sodium (Na), lithium (Li) or the like; organic alkali earth metal compounds including magnesium (Mg), calcium (Ca) or the like; organic metal compounds including aluminum (Al), zinc (Zn), manganese (Mn), antimony (Sb), titanium (Ti), tin (Sn), zirconium (Zr), germanium (Ge) or the like, for example, dibutyltin dilaurate, dibutyl tin oxide, and tetrabutyl titanate; a phosphorous acid compound; a phosphoric acid compound; an amine compound, and the like. In an environmental or safety aspect, titanium-based catalysts or aluminum-based catalysts may be used. An amount of the catalyst may be in the range of about 0.01 to about 3.00 wt % based on a total weight of the reactants.

Examples of polyvalent carboxylic acids that may be used to obtain the amorphous polyester resin include phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and cyclohexanedicarboxylic acid. Examples of polyvalent carboxylic acids, excluding dicarboxylic acids, include trimellitic acid, pyromellitic acid, naphthalene tricarboxylic acid, naphthalene tetracarboxylic acid, pyrene tricarboxylic acid, and pyrene tetracarboxylic acid. An acid anhydride, an acid chloride, or an ester may be used instead of the carboxylic acids in which the carboxylic groups of the carboxylic acids are converted to an anhydride group, an acyl chloride group, or an ester group, respectively. For example, terephthalic acid or a lower ester thereof, diphenylacetic acid, or cyclohexane dicarboxylic acid, among the polyvalent cyclic acids listed above, may be used. In this regard, a lower ester means an ester of a C1-C8 aliphatic alcohol.

Examples of polyhydric alcohols that may be used to obtain the amorphous polyester resin include aliphatic diols, such as ethylene glycol, diethylene glycol, triethylene glycol, propylene glycol, butandiol, hexanediol, neopentyl glycol, and glycerin; alicyclic diols, such as cyclohexanediol, cyclohexanedimethanol, and hydrogenated bisphenol-A; and aromatic diols, such as an ethyleneoxide adduct of bisphenol-A and a propyleneoxide adduct of bisphenol-A. These polyhydric alcohols may be used alone or in a combination of at least two thereof. For example, aromatic diols or alicyclic diols, among the polyhydric alcohols listed above, may be used. In this regard, aromatic diols may be used. In order to ensure excellent fixability, trihydric or higher alcohols, such as glycerin, trimethylolpropane, or pentaerythritol, may be used together with diols to provide a cross-linked or branched structure.

The amorphous polyester resin may be prepared by condensating the polyhydric alcohol and the polyvalent carboxylic acid according to a general method. For example, the polyhydric alcohol and the polyvalent carboxylic acid are mixed, together with a catalyst, if necessary, in a reaction vessel equipped with a thermometer, a stirrer, and a condenser, and heated at 150° C. to 250° C. in an inert gas (for example, nitrogen gas) until the mixture reaches a predetermined acid value, while residual low-molecular weight compounds are continuously removed from the reaction system. Then, the reaction product is cooled to obtain an amorphous polyester resin as a final reaction product.

Examples of a catalyst that may be used to prepare the amorphous polyester resins include, but are not limited to, organometallic compounds, such as organic alkali metal compounds including sodium (Na), lithium (Li) or the like; organic alkali earth metal compounds including magnesium (Mg), calcium (Ca) or the like; organic metal compounds including aluminum(Al), zinc (Zn), manganese (Mn), antimony (Sb), titanium (Ti), tin (Sn), zirconium (Zr), germanium (Ge) or the like, for example, dibutyltin dilaurate, dibutyl tin oxide, and tetrabutyl titanate; a phosphorous acid compound; a phosphoric acid compound; an amine compound, and the like. In an environmental or safety aspect, titanium-based catalysts or aluminum-based catalysts may be used. An amount of the catalyst may be in the range of about 0.01 to about 3.00 wt % based on a total weight of the reactants.

The amorphous polyester resin may have a weight average molecular weight (Mw) of, for example, about 5,000 to about 60,000 g/mol, for example, about 15,000 to about 50,000 g/mol or about 15,000 to about 45,000 g/mol, when measured for a tetrahydrofuran (THF)-soluble component by gel permeation chromatography (GPC). When the Mw is within the above range, the low-temperature fixability and anti-offset property of the toner may be improved, and the strength of an image fixed on a paper is increased since the deterioration of the strength of resin is suppressed. In addition, the storage characteristics, such as anti-blocking characteristics, of the toner may be improved since a decrease in the glass transition temperature of the toner may be prevented.

The characteristics of the toner are also dependent on a type and an amount of the releasing agent since the releasing agent increases the low-temperature fixability of the toner, and durability and abrasion resistance of a final image. The releasing agent may be natural wax or synthetic wax. The releasing agent may be selected from, but is not limited to, the group consisting of polyethylene-based wax, polypropylene-based wax, silicone wax, paraffin-based wax, ester-based wax, carnauba wax, and metallocene wax. As described above, a melting temperature of the releasing agent may be from about 60° C. to about 100° C., for example, from about 70° C. to about 90° C. The releasing agent is physically attached to toner particles, but is not covalently bonded with toner particles.

The amount of the releasing agent may be from about 1 to about 20 parts by weight, for example, about 2 to about 16 parts by weight, or from about 3 to about 12 parts by weight based on 100 parts by weight of the toner. When the amount of the releasing agent is 1 part by weight or more, the toner has good low-temperature fixability and a sufficient fixing temperature range. When the amount of the releasing agent is 20 parts by weight or less, storage characteristics and economic feasibility of the toner may be improved.

The releasing agent may be ester group-containing wax. Examples of the ester group-containing wax include (1) mixtures including an ester-based wax and a non-ester-based wax; and (2) an ester group-containing wax prepared by adding an ester group to a non-ester based wax. Since an ester group has high affinity with respect to the binder component of the toner, the ester group-containing wax may be uniformly distributed among toner particles, and thus may effectively function. The non-ester based wax may suppress an excessive plasticizing effect, which occur when an ester-based wax is exclusively used. Therefore, toner containing the mixture wax may retain satisfactory development characteristics for a long period of time.

Examples of the ester-based wax include, but are not limited to, esters of monovalent to pentavalent alcohols and C15-C30 fatty acids such as behenyl behenate, stearyl stearate, stearic acid ester of pentaeritritol, or glyceryl montanate. The alcohols component of the esters may be C10-C30 monovalent alcohols or C3-C10 polyvalent alcohols. Examples of the non-ester-based wax include, but are not limited to, a polyethylene-based wax, a polypropylene-based wax, a silicone wax, and a paraffin-based wax.

Examples of the ester group-containing wax include a mixture including paraffin-based wax and an ester-based wax; and an ester group-containing paraffin-based wax. Specific examples thereof include P-212, P-280, P-318, P-319, and P-419 available from Chukyo Yushi Co., Ltd. If the releasing agent is a mixture of a paraffin-based wax and an ester-based wax, the amount of the ester-based wax may be in the range of about 5 to about 39 wt %, for example, about 7 to about 36 wt %, or about 9 to about 33 wt %, based on the total weight of the mixture. When the amount of the ester-based wax is greater than or equal to about 5 wt % based on the total weight of the mixture, the compatibility of the ester-based wax with a binder resin may be sufficiently maintained. When the amount of the ester-based wax is less than or equal to about 39 wt % based on the total weight of the mixture, toner may have appropriate plasticizing characteristics, and thus may retain satisfactory development characteristics for a long period of time.

The toner may include iron (Fe), silicon (Si) and zinc (Zn), wherein the amounts of Si and Fe are each in the range of about 3 to about 1000 ppm, a molar ratio of Si to Fe (Si/Fe) is in the range of about 0.1 to about 5, and the [Si]/[Fe] ratio and the [Zn]/[Fe] ratio may satisfy the following Conditions 9 and 10, wherein [Si], [Zn] and [Fe] denote the intensities of Si, Zn and Fe, respectively, as measured by X-ray fluorescence spectrometry:

$$0.0005 \leqq [Si]/[Fe] \leqq 0.05 \quad (9), \text{ and}$$

$$0.0005 \leqq [Zn]/[Fe] \leqq 0.5 \quad (10).$$

As used herein, [Zn] corresponds to the amount of Zn contained in a Zn-containing compound that is used as a catalyst in polymerizing the binder, i.e., polyester resin, of toner. If [Zn] is too low, polymerization efficiency may be considerably low, and it may take longer to complete the reaction. On the other hand, if [Zn] is too large, the reaction rate may be too high to be controlled, and the molecular weight may be significantly increased so that the resulting toner may not be able to be fixed at low temperatures. Furthermore, if [Zn] is too large, the electrical characteristics of the final toner may be adversely affected. Thus, [Zn] is to be controlled within an appropriate range. As used herein, [Fe] corresponds to the amount of Fe contained in an aggregating agent that is used to aggregate the latex (binder), the colorant and the releasing agent when toner is prepared. Thus, [Fe] may affect the aggregation properties, the particle size distribution and the particle size of aggregated toner. As used herein, [Si] corresponds to the amount of Si contained in an aggregating agent used for the toner or a silica external additive that is added to obtain the flowability of the toner. [Si] may affect properties of the toner like Fe, and may also affect flowability of the toner.

A ratio of [Zn] to [Fe], i.e., the [Zn]/[Fe] ratio may be from about $5.0\times10^{-4}$ to about $5.0\times10^{-3}$, for example, from about $5.0\times10^{-3}$ to about $5.0\times10^{-2}$. When the [Zn]/[Fe] ratio is less than 0.0005, latex (binder) synthesis may be difficult because the polymerizing rate is too slow due to a low [Zn], or a high [Fe] may adversely affect the aggregation properties or charging characteristics. When the [Zn]/[Fe] ratio exceeds 0.5, the molecular weight may be remarkably increased or the charging characteristics may be adversely affected due to the high [Zn], or the particle size distribution or particle size may be affected because an aggregation process is not effectively performed due to the low [Fe].

A ratio of [Si] to [Fe], i.e., the [Si]/[Fe] ratio may be, for example, in the range of about $5.0\times10^{-4}$ to about $5.0\times10^{-2}$, about $8.0\times10^{-4}$ to about $3.0\times10^{-2}$, or about $1.0\times10^{-3}$ to about $1.0\times10^{-2}$. If the [Si]/[Fe] ratio is less than about $5.0\times10^{-4}$, then the amount of silica, which is used as an external additive, may be too low, and thus the flowability of toner may deteriorate. On the other hand, if the [Si]/[Fe] ratio is greater than about $5.0\times10^{-2}$, then the amount of externally added silica may be too high, possibly resulting in the contamination of the internal components of the image forming apparatus in which the toner is employed.

The toner according to an embodiment may have a volume average diameter of about 3 to about 9 μm. For example, the volume average diameter may be from about 4 to about 8 μm or from about 4.5 to about 7.5 μm. In general, the smaller the toner particle size, the higher the resolution and the higher the quality of an image that may be achieved. However, when transfer speed and cleansing force are taken into consideration, small toner particles may not be appropriate for all applications. Thus, the appropriate toner particle size is an important consideration. The volume average diameter of the toner may be measured by electrical impedance analysis. When the volume average diameter is 3 μm or above, photoreceptor cleaning may be easily performed, a mass production yield may be improved, problems generated through scattering may be suppressed, and a high resolution and high quality image may be obtained. When the volume average diameter is 9 μm or lower, charging may be uniformly performed, fixability of the toner may be improved, and a doctor blade may easily control the toner layer on the photoreceptor.

An average circularity of the toner may be in the range of about 0.940 to about 0.980. For example, the average circularity may be in the range of about 0.945 to about 0.975, or about 0.950 to about 0.970. The average circularity may be calculated as follows. The average circularity may be in the range of 0 to 1, and as the average circularity approaches 1, the toner particle shape becomes more circular. When the toner has an average circularity of 0.940 or greater, an image developed on a transfer medium may have an appropriate thickness, and thus toner consumption may be reduced. In addition, voids between toner particles are not too large, and thus the image developed on the transfer medium may have a sufficient coating rate. On the other hand, when the toner has an average circularity of 0.980 or less, an excessive amount of toner being supplied onto a developer sleeve may be prevented, enabling to reduce the contamination of the developer sleeve that may result from the non-uniform coating of toner thereon.

The toner particle size distribution may be assessed using a volume average geometric size distribution coefficient (GSDv) or a number average geometric size distribution coefficient (GSDp). A method of measuring the GSDv or GSDp will be described below. GSDv and GSDp of the toner may be, respectively, about 1.3 or less and about 1.25 or less. The GSDv may be 1.30 or less, for example, from about 1.15 to about 1.30. The GSDp may be about 1.25 or less, for example, from about 1.20 to about 1.25. When each of the GSDv and GSDp is within the above ranges, the toner may have a uniform particle diameter.

The core layer of the toner according to the present general inventive concept includes a colorant. Examples of the colorant include a black colorant, a cyan colorant, a magenta colorant, and a yellow colorant.

The black colorant may be carbon black or aniline black.

The yellow colorant may be a condensed nitrogen compound, an isoindolinone compound, an anthraquinone compound, an azo metal complex, or an allyl amide compound. Examples of the yellow colorant include, but are not limited to, C.I. pigment yellows 12, 13, 14, 17, 62, 74, 83, 93, 94, 95, 109, 110, 111, 128, 129, 147, 168, and 180.

Examples of the magenta colorant include, but are not limited to, a condensed nitrogen compound, an anthraquinone compound, a quinacridone compound, a basic dye lake compound, a naphthol compound, a benzo imidazole compound, a thioindigo compound, and a perylene compound. Specifically, examples of the magenta colorant include, but are not limited to, C.I. pigment reds 2, 3, 5, 6, 7, 23, 48:2, 48:3, 48:4, 57:1, 81:1, 122, 144, 146, 166, 169, 177, 184, 185, 202, 206, 220, 221, and 254.

Examples of the cyan colorant include a copper phthalocyanine compound and derivatives thereof, and an anthraquinone compound. Specifically, examples of the cyan colorant include, but are not limited to, C.I. pigment blues 1, 7, 15, 15:1, 15:2, 15:3, 15:4, 60, 62, and 66.

These colorants may be used alone or in combination of at least two thereof, and may be selected in consideration of color, chromaticity, brightness, weather resistance, or dispersibility in toner.

The amount of the colorant is not limited as long as it is sufficient to color the toner. For example, the amount of the colorant may be in the range of about 0.5 to about 15 parts by weight, about 1 to about 12 parts by weight, or about 2 to about 10 parts by weight, based on 100 parts by weight of toner. When the amount of the colorant is 0.5 parts by weight or above based on 100 parts by weight of the toner, a coloring effect may be satisfactorily shown. On the other hand, when the amount of the colorant is 15 parts by weight or less, a manufacturing cost of the toner does not significantly increase, and a sufficient amount of charge may be provided.

According to the toner of the embodiment, the shell layer is disposed on the core layer. The shell layer includes the second binder resin including the amorphous polyester resin. The shell layer prevents crystalline materials, such as the crystalline polyester resin and the releasing agent, of the core layer that adversely affect the charging characteristics of the toner from being externally exposed, thereby increasing the charging stability and durability of the toner.

A method of preparing a toner for developing an electrostatic image, according to an embodiment, provides a polymerization toner having a core-shell structure that stably forms a high quality image for a long period of time since the polymerization toner not only has excellent durability with respect to an environment, but also excellent color realization, low-temperature fixability, charging stability, and high-temperature storage characteristics by using an emulsion aggregation (EA) method for precisely controlling particle size reduction and particle size distribution, besides controlling the compatibility of the crystalline and amorphous polyester resins and the releasing agent.

The method includes preparing a mixed solution by mixing a latex of a first binder resin, a colorant, and a releasing agent, wherein the first binder resin includes about 70 wt % or above of an amorphous polyester resin, and about 30 wt % or below of a crystalline polyester resin; forming a core particle including the first binder resin, the colorant, and the releasing agent by adding an aggregating agent to the mixed solution; adding a latex of the second binder to a dispersion of the core particle to coat a second binder resin on a surface of the core particle, forming a shell layer on the surface of the core particle and growing the core particle size, wherein the second binder resin comprises an amorphous polyester resin; and heating the dispersion to control the shape of a toner particle including the core layer and the shell layer, wherein the melting temperature (Tm(C)) of the crystalline polyester resin, the melting temperature (Tm(W)) of the releasing agent, and the melting temperature (Tm(T)) of the toner satisfy Conditions 1 and 2 below:

$$-20^\circ\text{ C.} \leqq Tm(W)-Tm(C) \leqq 20^\circ\text{ C.} \quad (1), \text{ and}$$

$$0^\circ\text{ C.} < Tm(C)-Tm(T) \leqq 10^\circ\text{ C.} \quad (2).$$

The glass transition temperature (Tg(A)) of the amorphous polyester resin of the core layer and the glass transition temperature (Tg(T)) of the toner may satisfy Condition 3 below:

$$0^\circ\text{ C.} < Tg(A)-Tg(T) \leqq 10^\circ\text{ C.} \quad (3).$$

The Tm(C) of the crystalline polyester resin and the Tm(W) of the releasing agent may satisfy Conditions 4 and 5 below:

$$60^\circ\text{ C.} < Tm(C) < 100^\circ\text{ C.} \quad (4), \text{ and}$$

$$60^\circ\text{ C.} < Tm(W) < 100^\circ\text{ C.} \quad (5).$$

First, the operation of preparing the mixed solution will now be described. The latex of the first binder resin including about 70 wt % or more of an amorphous polyester resin and about 30 wt % or less of a crystalline polyester resin based on the dried weight of the latex of the first binder resin is prepared. The latex of the first binder resin is prepared by mixing the amorphous polyester resin and the crystalline polyester resin that are described above. The amorphous polyester resin and the crystalline polyester resin are each prepared in a latex form by using a phase inversion emulsification method. For this, the amorphous polyester resin is dissolved in an organic solvent to prepare an amorphous polyester organic solution.

Any known organic solvent may be used, but generally, the organic solvent may be a ketone solvent such as acetone or methyl ethyl ketone; an aliphatic alcohol solvent such as methanol, ethanol, or isopropanol; or a mixture thereof. Then, a NaOH, KOH, or ammonium hydroxide solution is added to the amorphous polyester organic solution, and is stirred. Herein, the amount of the basic compound is determined based on the amount of a carboxyl group calculated from the acid value of the amorphous polyester resin. Then, an excessive amount of water is added to the amorphous polyester organic solution to perform phase inversion emulsification of converting the polyester organic solution into an oil-in-water emulsion. Here, a surfactant may be selectively added. The organic solvent is removed from the oil-in-water emulsion by using a distillation method under reduced pressure, or the like, thereby obtaining an amorphous polyester resin latex. The resulting latex particles may have an average diameter of about 1 μm or less, for example, in the range of about 100 to about 300 nm, or in the range of about 150 to about 250 nm.

The solid amount of the amorphous polyester resin latex is not specifically limited, but may be in the range of about 5 wt % to about 40 wt %, for example, in the range of about 15 wt % to about 30 wt %. A crystalline polyester resin latex is prepared in the same manner. The amorphous polyester resin latex and the crystalline polyester resin latex are mixed with each other to prepare the latex of the first binder resin that functions as a binder resin of the core layer.

The amorphous or crystalline polyester resin latex may include, if necessary, another polymer obtained by polymerizing at least one polymerizable monomer. The polymerizable monomer used herein may include at least one selected from the group consisting of styrene-based monomers such as styrene, vinyltoluene, or α-methylstyrene; acrylic acids, methacrylic acids; derivatives of (meth)acrylic acid such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide, or methacrylamide; ethylenically unsaturated monoolefins such as ethylene, propylene, or butylene; halogenated vinyls such as vinyl chloride, vinylidene chloride, or vinyl fluoride; vinyl esters such as vinyl acetate or vinyl propionate; vinyl ethers such as vinylmethylether or vinylethylether; vinyl ketones such as vinylmethylketone or methylisoprophenylketone; and a nitrogen-containing vinyl compound such as 2-vinylpyridine, 4-vinylpyridine, or N-vinylpyrrolidone.

The amorphous or crystalline polyester resin latex may further include a charge control agent. Examples of the charge control agent that may be used herein include a negatively charged charge control agent and a positively charged charge control agent. Examples of the negatively charged charge control agent include an organic metal complex such as a chromium-containing azo complex or a monoazo metal complex, or chelate compounds; metal-containing salicylic acid compounds wherein the metal may be chromium, iron, or zinc; and organic metal complexes of aromatic hydroxycarboxylic acids or aromatic dicarboxylic acid. However, the negatively charged charge control agent may not be particularly limited as long as it is known to one of ordinary skill in the art. In addition, the positively charged charge control agent may be a modified compound with nigrosine or a fatty acid metal salt thereof; or an onium salt including a quaternary ammonium cation such as tributylammonium 1-hydroxy-4-naphtholsulfonate or tetrabutylammonium tetrafluoroborate. The charge control agent may operate to stably support the toner on a developing roller with an electrostatic force. Thus, by using the charge control agent, stable and high-speed charging may be ensured.

The latex of the first binder resin obtained as described above is mixed with a colorant dispersion and a releasing agent dispersion to prepare the mixed solution.

The colorant dispersion may be obtained by uniformly dispersing a composition including a colorant, such as a black colorant, a cyan colorant, a magenta colorant, or a yellow colorant, and an emulsifier by using an ultrasonic homogenizer or a micro fluidizer. The type and amount of the colorant that may be used are as described above. These colorants may be used alone or in combination of at least two thereof, and may be selected in consideration of color, chromaticity, brightness, weather resistance, or dispersibility in toner. Here, any known emulsifier may be used as the emulsifier used to prepare the colorant dispersion. For example, the emulsifier may be an anionic reactive emulsifier, a non-ionic reactive emulsifier, or a mixture thereof. Examples of the anionic reactive emulsifier include HS-10 (manufactured by Dai-ich Kogyo Seiyaku Co., Ltd.) and Dowfax 2A1 (manufactured by Rhodia). Examples of the non-ionic reactive emulsifier include RN-10 (manufactured by Dai-ichi Kogyo Seiyaku Co., Ltd.).

The releasing agent dispersion includes a releasing agent, water, an emulsifier, or the like. The type and amount of the releasing agent that may be used are as described above. The emulsifier included in the releasing agent dispersion is not limited as long as it is known, like the emulsifier used for the colorant dispersion. A molecular weight, a Tg, and rheological properties of each of the amorphous and crystalline polyester resin latex prepared according to the method may be controlled to be fixed at a low fixing temperature. Also, an acid value ($RA_{av}$) of the releasing agent, an acid value ($APE1_{av}$) of the amorphous polyester resin of the core layer, an acid value ($CPE_{av}$) of the crystalline polyester resin, and an acid value ($APE2_{av}$) of the amorphous polyester resin of the shell layer may satisfy Conditions 6 through 8 below:

$$RA_{av} \leqq APE1_{av} \leqq CPE_{av} \leqq APE2_{av} \quad (6),$$

$$CPE_{av} - APE1_{av} \leqq 5 \text{ through } 10 \quad (7), \text{ and}$$

$$APE2_{av} - CPE_{av} \leqq 5 \text{ through } 10 \quad (8).$$

The mixed solution is prepared by mixing the latex of the first binder resin, the colorant dispersion, and the releasing agent dispersion together. The mixed solution may be prepared by using a homomixer, homogenizer, or the like.

Then, aggregated toner is prepared by adding an aggregating agent to the mixed solution. In detail, the pH of the mixed solution is adjusted to be in the range of about 0.1 to about 4.0, and then the aggregating agent is added to the mixed solution so as to aggregate the mixed solution at a temperature equal to or lower than a melting temperature of the crystalline polyester resin and equal to or below the Tg of the amorphous polyester resin, for example, in the range of about 25 to about 60° C., in detail, about 35 to about 50° C., and the aggregated mixed solution is fused at a temperature equal to or above the melting temperature of the crystalline polyester resin and equal to or above the Tg of the amorphous polyester resin, for example, in the range of about 85 to about 100° C. to prepare a primary aggregated toner having a particle size of about 4 to about 7 μm. Alternatively, in preparing the primary aggregated toner, miniature toner having a particle size of about 0.5 to about 3 μm, for example about 2 to about 3 μm, may first be prepared, and followed by aggregation to finally obtain the primary aggregated toner having a particle size of about 4 to about 7 μm, for example about 4.5 to about 6.5 μm.

Once the primary aggregated toner particles forming the core layer has been prepared, the latex of the second binder resin, optionally with a releasing agent, to form the shell layer, are added thereto, and the pH of the system is adjusted to a pH of about 6 to about 9 and left until a particle size of the mixture is maintained constant for a predetermined period of time. Then, the temperature is raised to about 90 to about 98° C., and the pH is lowered to about 5 to about 6 in order to coalesce the primary aggregated toner particles into a secondary aggregated toner.

A Si- and Fe-containing metal salt may be used as the aggregating agent. When such a metal salt containing Si and Fe is used, the primary aggregated toner particles may have a larger particle size due to enhanced ionic strength and interparticular collisions. The Si and Fe-containing metal salt may include polysilicate iron. Examples of the Si and Fe-containing metal salt include, but are not limited to, PSI-025, PSI-050, PSI-075, PSI-100, PSI-200, and PSI-300, which are products manufactured by Suido Kiko Co. Ltd. Properties and compositions of these aggregating agents are shown in Table 1 below. The Si and Fe-containing metal salt shows strong aggregating force even when a smaller amount is used at a lower temperature, compared to an aggregating agent used in a conventional EA method. Moreover, since the Si and Fe-containing metal salt includes Fe and Si as the main components, the effect of the residual aluminum on the environment and human body, which is the effect of a conventional trivalent aluminum polymer aggregating agent, may be minimized.

TABLE 1

| Type | | PSI-025 | PSI-050 | PSI-085 | PSI-100 | PSI-200 | PSI-300 |
|---|---|---|---|---|---|---|---|
| Si/Fe Mole Ratio | | 0.25 | 0.5 | 0.85 | 1 | 2 | 3 |
| Concentration of Main Component | Fe (wt %) | 5.0 | 3.5 | 2.5 | 2.0 | 1.0 | 0.7 |
| | SiO2 (wt %) | 1.4 | 1.9 | 2.0 | | 2.2 | |
| pH (1 w/v %) | | | | 2-3 | | | |
| Specific Gravity (20° C.) | | 1.14 | 1.13 | 1.09 | 1.08 | 1.06 | 1.04 |
| Viscosity (mPa · S) | | | | 2.0 or greater | | | |
| Number Average Molecular Weight (g/mol) | | | | 500,000 | | | |
| Appearance | | | | Transparent, Yellowish Brown Liquid | | | |

The amount of the aggregating agent may be in the range of about 0.1 to about 10 parts by weight, for example, about 0.5 to about 8 parts by weight, or about 1 to about 6 parts by weight, based on 100 parts by weight of particles of the first binder resin latex. In this regard, when the amount of the aggregating agent is greater than or equal to about 0.1 parts by weight, aggregation efficiency may increase. When the amount of the aggregating agent is less than or equal about 10 parts by weight, the charging characteristics of toner may not be degraded, and the particle size distribution may become more uniform.

Furthermore, the secondary aggregated toner may be additionally coated with tertiary latex particles. The tertiary latex particles may also be prepared from a polyester resin alone or a mixture of a polyester resin and a polymer prepared by polymerizing at least one polymerizable monomer.

By forming the shell layer from the secondary latex particles or tertiary latex particles, toner may have higher durability and excellent storage characteristics during shipping and handling. The obtained secondary aggregated toner or tertiary aggregated toner may be filtered to separate toner particles, and toner particles are dried. Then, an external additive is added to the dried toner particles, thereby obtaining a final dry toner. The external additive may include silica, titania, alumina, or strontium titanate, and so on. The amount of the external additive may be in the range of about 1.5 to about 7 parts by weight, or about 2 to about 5 parts by weight, based on 100 parts by weight of toner to which the external additive is not added. When the amount of the external additive is about 1.5 parts by weight or above, a caking phenomenon, where toner particles cohere with each other to form a cake according to the cohesive force between the toner particles, may be prevented, and thus the amount charge applied to toner particles may be uniform. When the amount of the external additive is about 7 parts by weight or below, a roller may be suppressed from being contaminated by the external additive.

An imaging method according to an embodiment includes: attaching toner to a surface of an image carrier, such as photoreceptor, on which an electrostatic latent image is formed so as to form a visualized image; and transferring the visualized image onto a transfer medium, wherein the toner is the toner according to the present general inventive concept for developing the electrostatic image as described above.

Electrophotographic imaging processes include a series of steps for forming an image on a receptor, including charging, exposure-to-light, developing, transferring, fixing, cleaning, and erasing processes.

In the charging process, a surface of an image carrier, such as a photoreceptor, is charged with negative or positive charges, whichever is desired, by a corona or a charging roller.

In the exposure-to-light process, the charged surface of the image carrier is selectively discharged using a laser scanner or an array of diodes in an image-wise manner in order to form a latent image corresponding to a final visual image to be formed on a final-image receptor, such as, for example, a sheet of paper. Electromagnetic radiation that may be referred to as "light radiation" include, but are not limited to, infrared radiation, visible light radiation, and ultraviolet radiation.

In the developing process, toner particles having an appropriate polarity contact the latent image on the image carrier. To this end, an electrically-biased developer having the same potential polarity as the polarity of toner particles is used. The toner particles move toward the image carrier and are selectively attached to the latent image of the image carrier due to an electrostatic force to thereby form a visualized image, such as a toner image, on the image carrier.

In the transferring process, the toner image is transferred from the image carrier to the final image receptor. In some cases, an intermediate transferring element may be used to transfer the toner image from the image carrier to the final image receptor.

In the fixing process, the toner image on the final image receptor is heated so that particles of the toner are softened or molten and are fixed to the final image receptor. An alternative fixing method may involve fixing the toner image to the final-image receptor under high pressure with or without the application of heat.

In the cleaning process, residual toner remaining on the image carrier is removed.

Finally, in the charge-erasing process, the charges on the image carrier are exposed to light having a specific wavelength, and thus are uniformly erased to result in a substantially lower amount of charges on the image carrier. Therefore, the residue of the latent image is removed, and the image carrier is made available for a further imaging cycle.

A toner supplying unit according to an embodiment includes: a toner tank in which toner may be stored; a supplying part protruding from an inner surface of the toner tank to externally supply toner from the toner tank; and a toner-agitating member rotatably disposed inside the toner tank to agitate toner in almost the entire inner space of the toner tank including a space above a top surface of the supplying part, wherein the toner is the toner according to the present general inventive concept for developing the electrostatic image as described above.

FIG. 1 is a perspective view of a toner supplying unit 100 according to an embodiment. Referring to FIG. 1, the toner supplying unit 100 may include a toner tank 101, a supplying part 103, a toner-conveying member 105, and a toner-agitating member 110.

The toner tank 101 is configured to store therein a predetermined amount of toner, and may have a substantially hollow cylindrical shape. The supplying part 103 may be disposed on an inner bottom surface of the toner tank 101, and may be configured to externally discharge toner contained in the toner tank 101. For example, the supplying part 103 may protrude from the bottom of the toner tank 101 to have a pillar shape with a semi-circular cross-section. The supplying part 103 may include a toner outlet (not shown) in an outer side thereof, through which the toner may be discharged. The toner-conveying member 105 may be disposed at a side of the supplying part 103 on the inner bottom surface of the toner tank 101. The toner-conveying member 105 may have, for example, a coil spring shape. An end of the toner-conveying member 105 may extend inside the supplying part 103 so that toner in the toner tank 101 is conveyed into the supplying part 103 as the toner-conveying member 105 rotates. Toner conveyed by the toner-conveying member 105 may be externally discharged through the toner outlet of the supplying part 103.

The toner-agitating member 110 is rotatably disposed inside the toner tank 101 and forces toner in the toner tank 101 to move downward. For example, when the toner-agitating member 110 rotates at a middle of the toner tank 101, toner in the toner tank 101 is agitated to prevent toner from solidifying. As a result, toner moves down to the bottom of the toner tank 101 due to gravity. The toner-agitating member 110 includes a rotation shaft 112 and a toner-agitating film 120. The rotation shaft 112 is rotatably disposed at the middle of the toner tank 101, and may have a driving gear (not shown) that may be coaxially coupled with an end of the rotation shaft 112 protruding from a side of the toner tank 101. Therefore, the rotation of the driving gear causes the rotation shaft 112 to rotate. Also, the rotation shaft 112 may have a support plate 114 to help fix the toner-agitating film 120 to the rotation shaft 112. The support plate 114 may be formed substantially symmetrical about the rotation shaft 112.

The toner-agitating film 120 has a width corresponding to the inner length of the toner tank 101. Furthermore, the toner-agitating film 120 may be elastically deformable in consideration of the shape of a projection inside the toner tank 101, i.e., the supply part 103. The toner-agitating film 120 may include a first agitating part 121 and a second agitating part 122 formed by cutting an end of the toner-agitating film 120 toward the rotation shaft 112 by a predetermined length.

An image-forming apparatus according to an embodiment includes: an image carrier; an imaging unit for forming an electrostatic image on the surface of the image carrier; a unit containing toner; a toner supplying unit to supply toner to the surface of the image carrier to develop the electrostatic image into a toner image; and a toner transfer unit to transfer the toner image formed on the surface of the image carrier to a transfer medium, wherein the toner is the toner according to embodiments for developing an electrostatic image as described above.

Figure 2:
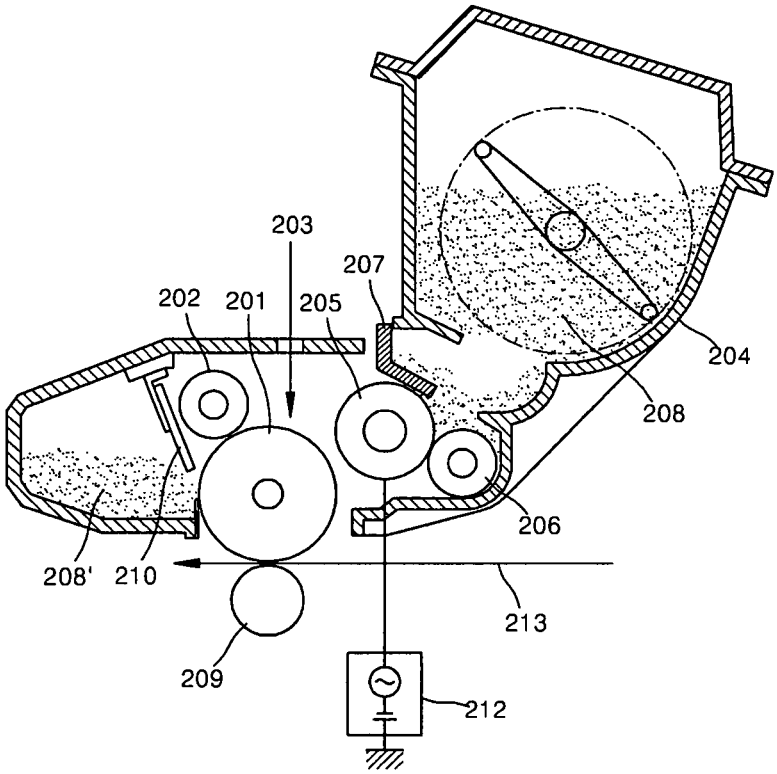
FIG. 2 is a schematic view of an image-forming apparatus according to an embodiment.

FIG. 2 is a schematic view of a non-contact development type imaging apparatus including toner prepared using the method described in the previous embodiment, according to an embodiment.

A non-magnetic one-component developer, i.e., toner 208, in a developing device 204 is supplied to a developing roller 205 by a supply roller 206 formed of an elastic material, such as polyurethane foam or sponge. The toner 208 supplied onto the developing roller 205 reaches a contact portion between a developer-regulating blade 207 and the developing roller 205 as the developing roller 205 rotates. The developer-regulating blade 207 may be formed of an elastic material, such as metal or rubber. When toner 208 passes through the contact portion between the developer-regulating blade 207 and the developing roller 205, the amount of toner 208 may be regulated to be a thin layer of a uniform thickness, and may also be sufficiently charged. The toner 208 which has been formed into a thin layer is transferred to a development region of a photoreceptor 201 where a latent image on the surface of the photoreceptor 201 is developed with the toner supplied by the developing roller 205, wherein the photoreceptor 201 is an example of an image carrier. As previously described, the electrostatic latent image is formed by scanning light 203 onto the photoreceptor 201.

The developing roller 205 is arranged to face the photoreceptor 201 while being spaced apart from the photoreceptor 201 by a predetermined distance. The developing roller 205 and the photoreceptor 201 may rotate in opposite directions with respect to each other. For example, the developing roller 205 may rotate in a counterclockwise direction, whereas the photoreceptor 201 may rotate in a clockwise direction.

According to an embodiment, toner 208, which has been transferred to the development region of the photoreceptor 201, develops the latent image formed on the photoreceptor 201 into a toner image using an electrostatic force generated due to the potential difference between a direct current (DC)-biased alternating current (AC) voltage applied to the developing roller 205 and the latent potential of the photoreceptor 201 charged by a charging unit 202.

The toner image, which has been developed on the photoreceptor 201, reaches a transfer unit 209 as the photoreceptor 201 rotates. The toner image, which has been developed on the photoreceptor 201, is transferred to a print medium 213 when the print medium 213 is passed between the photoreceptor 201 and the transfer unit 209 by the transfer unit 209 having a roller shape and to which a high voltage having a polarity opposite to toner 208 is applied.

The toner image transferred to the print medium 213 passes through a high-temperature, high-pressure fusing device (not shown), and thus is fused to the print medium 213, thereby resulting in a fixed image. The non-developed, residual developer 208' on the developing roller 205 is collected by the supply roller 206 contacting the developing roller 205 whereas the non-developed, residual developer 208' on the photoreceptor 201 is collected by a cleaning blade 210. The processes described above may be repeated for the formation of subsequent images.

Hereinafter, one or more embodiments of the present general inventive concept will be described in more detail with reference to the following examples. However, these examples are not intended to limit the scope of the one or more embodiments of the present general inventive concept.

EXAMPLES

Properties of an amorphous polyester resin and a crystalline polyester resin used in Preparation Examples are shown in Table 2 and 3 below.

TABLE 2

| Amorphous Polyester Resin | Glass Transition Temperature Tg(A) (° C.) | Number Average Molecular Weight (g/mol) |
|---|---|---|
| A-1 | 69 | 19000 |
| A-2 | 70 | 45000 |

TABLE 3

| Crystalline Polyester Resin | Melting Temperature Tm(C) (° C.) | Endothermic Heat of Fusion (A(C)) (J/g) | Number of Carbon of Dibasic Acid | Number of Carbon of Diol |
|---|---|---|---|---|
| PC-1 | 52 | 54.5 | 4 | 6 |
| PC-2 | 78 | 73.6 | 9 | 12 |
| PC-3 | 89 | 140.5 | 10 | 12 |
| PC-4 | 120 | 154.5 | 10 | 12 |

The glass transition temperatures and melting temperatures of the amorphous polyester resin and the crystalline polyester resin are measured according to methods described below. Here, Mw denotes a weight average molecular weight when measured for tetrahydrofuran (THF)-soluble component by gel permeation chromatography (GPC).

Preparation Example 1-1

Preparation of Latex A-1 Including Amorphous Polyester Resin A-1

500 g of amorphous polyester resin A-1, 400 g of methylethylketone (MEK), and 100 g of isopropylalcohol (IPA) were placed in a 3 L double-jacketed reactor, and the polyester resin A-1 was dissolved at 30° C. while stirring with a mechanical stirrer to obtain a polyester resin solution. 30 g of 10% aqueous ammonia solution was slowly added to the polyester resin solution while stirring, and 1,500 g of water was further added at a rate of 50 g/min while continuously stirring to prepare an emulsion. The solvent was removed from the emulsion by a distillation method under reduced pressure to obtain latex A-1 having a 25% solid content. According to results of measuring a particle size of the latex A-1 by using a particle size analyzer (Horiba 910), a volume average diameter was about 156 nm, and GSDv was about 1.10.

Preparation Example 1-2

Preparation of Latex A-2 Including Amorphous Polyester Resin A-2

Latex A-2 was prepared in the same manner as in Preparation Example 1-1, except that amorphous polyester resin A-2 was used instead of amorphous polyester resin A-1. According to results of measuring a particle size of the latex A-2 by using a particle size analyzer (Horiba 910), a volume average diameter was about 160 nm, and GSDv was about 1.11.

Preparation Example 2-1

Preparation of Latex PC-1 Including Crystalline Polyester Resin PC-1

500 g of crystalline polyester resin P-1, 400 g of MEK, and 100 g of IPA were placed in a 3 L double-jacketed reactor, and the polyester resin P-1 was dissolved at 60° C. while stirring with a mechanical stirrer to obtain a polyester resin solution. 30 g of 10% aqueous ammonia solution was slowly added to the polyester resin solution while stirring, and 1,500 g of water was further added at a rate of 50 g/min while continuously stirring to prepare an emulsion. The solvent was removed from the emulsion by a distillation method under reduced pressure to obtain latex PC-1 having a 25% solid content. According to results of measuring a particle size of the latex PC-1 by using a particle size analyzer (Horiba 910), a volume average diameter was about 158 nm, and GSDv was about 1.11.

Preparation Example 2-2

Preparation of Latex PC-2 Including Crystalline Polyester Resin PC-2

Latex PC-2 was prepared in the same manner as in Preparation Example 2-1, except that crystalline polyester resin PC-2 was used instead of crystalline polyester resin PC-1. According to results of measuring a particle size of the latex PC-2 by using a particle size analyzer (Horiba 910), a volume average diameter was about 160 nm, and GSDv was about 1.11.

Preparation Example 2-3

Preparation of Latex PC-3 Including Crystalline Polyester Resin PC-3

Latex PC-3 was prepared in the same manner as in Preparation Example 2-1, except that crystalline polyester resin PC-3 was used instead of crystalline polyester resin PC-1. According to results of measuring a particle size of the latex PC-3 by using a particle size analyzer (Horiba 910), a volume average diameter was about 164 nm, and GSDv was about 1.11.

Preparation Example 2-4

Preparation of Latex PC-4 Including Crystalline Polyester Resin PC-4

Latex PC-4 was prepared in the same manner as in Preparation Example 2-1, except that Crystalline Polyester Resin PC-4 was used instead of Crystalline Polyester Resin PC-1. According to results of measuring a particle size of the latex PC-4 by using a particle size analyzer (Horiba 910), a volume average diameter was about 160 nm, and GSDv was about 1.11.

Example 3

Preparation of Colorant Dispersion 10 g of an anionic reactive emulsifier (HS-10; Dai-Ichi Kogyo Seiyaku Co., Ltd.) and 60 g of cyan pigment (PB 15:4)

were loaded into a milling bath and then, 400 g of glass beads having a diameter of 0.8 to 1 mm was added thereto and then milled at room temperature to prepare a cyan colorant dispersion. A homogenizer used in this experiment was an ultrasonic homogenizer or a micro fluidizer.

[Releasing Agent Dispersion]

Wax Dispersions available from Chukyo Yushi Co., Ltd and having the following compositions shown in Table 4 were used.

TABLE 4

| | P-212 | P-280 | P-318 | P-319 | P-419 |
|---|---|---|---|---|---|
| Paraffin Wax Content (wt %) | 40-70% | 70-97% | 85-97% | 100% | 40-70% |
| Synthetic Ester Wax Content (wt %) | 30-60% | 3-30% | 3-15% | — | 30-60% |
| Melting Point* | 77° C. | 81° C. | 80° C. | 80° C. | 90° C. |

*Measured in DSC according to a method described below.

Example 1

Aggregation and Preparation of Toner 316 g of deionized water, 250 g of latex A-1, and 57 g of latex PC-2 were added to a 1 L reactor and stirred at 350 rpm. 35 g of the cyan colorant dispersion (HS-10 100%) prepared in Preparation Example 3 and the wax dispersion P-419 (manufactured by Chukyo Yushi Co., Ltd) were input to the 1 L reactor, and then 30 g of 0.3N nitric acid (0.3 mol) and 15 g of 12% PSI-100 (manufactured by Suido Kiko Co. Ltd.) as an aggregating agent were further input to the 1 L reactor, and then stirred using a homogenizer at a rate of 11,000 rpm for 6 minutes while gradually heating the 1 L reactor up to 45° C., thereby obtaining miniature toner having a volume average diameter of about 0.5 to about 3 μm. Then, the miniature toner was aggregated for 2 hours, thereby obtaining primary aggregated toner having a volume average diameter of about 4 to about 5 μm.

Then, 150 g of latex A-2 prepared was input to the 1 L reactor, and when a volume average diameter of the latex A-2 reached about 5 to about 6 μm, 1 mol of NaOH was added to adjust the pH to 7. When the volume average diameter was maintained constant for 10 minutes, the temperature was increased to about 95° C. at a rate of 0.5° C./min. When the temperature reached 95° C., 0.3 mol of nitric acid was added thereto to adjust the pH to about 5.7. Then, the resultant was fused for 4 to 5 hours to obtain a secondary aggregated toner having a volume average diameter of about 5.5 to about 6.5 μm and a potato shape. Then, the aggregated reaction solution was cooled to a temperature lower than Tg, and then was filtered to isolate toner particles, followed by drying.

100 g of the dried toner particles, 0.5 g of NX-90 (manufactured by Nippon Aerosil Co., Ltd.), 1.0 g of RX-200 (manufactured by Nippon Aerosil Co., Ltd.), and 0.5 g of SW-100 (manufactured by Titan Kogyo Kabushiki Kaisha) were put into a mixer (KM-LS2K, DaeHwa Tech. Co., Ltd.), and an external additive was added to the toner particles while stirring the toner particles for 4 minutes at 8,000 rpm. The resultant toner had a volume average diameter in the range of about 5.5 to about 6.0 μm. The resultant toner had a GSDv of about 1.22 and a GSDp of about 1.23. The average circularity of the resultant toner was about 0.972.

Examples 2 through 5 and Comparative Example 1 through 3

Aggregation and Preparation of Toner

Amorphous and crystalline polyester resin latexes for the core layer, an amorphous polyester resin latex for the shell layer, and a wax dispersion were used to prepare toner particles while changing them as shown in Table 5 below. Here, a [Zn]/[Fe] ratio, a [Si]/[Fe] ratio, a volume average diameter, an average circularity, a GSDv, and a GSDp of the toner particles obtained according to Examples 1 through 5 and Comparative Examples 1 through 3 were in the range of a predetermined level described above.

TABLE 5

| | Amorphous Polyester Resin Latex for Core Layer | Crystalline Polyester Resin Latex for Core Layer | Amorphous Polyester Resin Latex for Shell Layer | Wax Dispersion |
|---|---|---|---|---|
| Example 1 | A-1 | PC-2 | A-2 | P-419 |
| Example 2 | A-1 | PC-3 | A-2 | P-419 |
| Example 3 | A-1 | PC-2 | A-2 | P-212 |
| Example 4 | A-1 | PC-2 | A-2 | P-318 |
| Example 5 | A-1 | PC-2 | A-2 | P-280 |
| Comparative Example 1 | A-1 | PC-1 | A-2 | P-419 |
| Comparative Example 2 | A-1 | PC-4 | A-2 | P-419 |
| Comparative Example 3 | A-1 | PC-2 | A-2 | P-319 |

A glass transition temperature (Tg(A)) of the amorphous polyester resin for the core layer, a melting temperature (Tm(C)) of the crystalline polyester resin for the core layer, a melting temperature (Tm(W)) of the wax, a transition glass temperature (Tg(T)) of the obtained toner, and a melting temperature (Tm(T)) of the obtained toner according to Examples 1 through 5 and Comparative Examples 1 through 3 are as shown in Table 6 below.

TABLE 6

| | Tg(A) | Tm(C) | Tm(W) | Tg(T) | Tm(T) |
|---|---|---|---|---|---|
| Example 1 | 69 | 78 | 90 | 64 | 77 |
| Example 2 | 69 | 89 | 90 | 63 | 86 |
| Example 3 | 69 | 78 | 77 | 60 | 73 |
| Example 4 | 69 | 78 | 80 | 59 | 71 |
| Example 5 | 69 | 78 | 81 | 60 | 74 |
| Comparative Example 1 | 69 | 52 | 90 | 45 | N/A (no peak) |
| Comparative Example 2 | 69 | 120 | 90 | 59 | 100 |
| Comparative Example 3 | 69 | 78 | 80 | 67 | 78 |

Table 7 below shows various properties of the toner prepared according to Examples 1 through 5 and Comparative Examples 1 through 3.

TABLE 7

| | DSC | | Fixability | | | High-Temperature | |
|---|---|---|---|---|---|---|---|
| | ΔTg (° C.) * | ΔTm (° C.) ** | MFT: (° C.) | HOT: (° C.) | Gloss (%) | Storage Characteristics | Charging Stability |
| Example 1 | 5 | 1 | 110 | Slightly greater than 200 | 11 | ○ | ○ |
| Example 2 | 6 | 3 | 100 | 200 | 12 | ○ | ○ |
| Example 3 | 9 | 5 | 100 | 190 | 12 | ○ | ○ |
| Example 4 | 10 | 7 | 110 | 180 | 13 | ○ | ○ |
| Example 5 | 9 | 4 | 110 | 200 | 13 | ○ | ○ |
| Comparative Example 1 | 24 | N/A | 120 | 160 | 8 | X | Δ |
| Comparative Example 2 | 10 | 20 | 170 | Slightly greater than 200 | 4 | ○ | X |
| Comparative Example 3 | 2 | 0 | 150 | 190 | 2 | ○ | X |

* ΔTg = Tg(A) − Tg(T),
** ΔTm = Tm(C) − Tm(T).

Evaluation of Toner

<Evaluation on Average Circularity>

The toner particle shape is checked by using a scanning electron microscope (SEM). The circularity of toner may be measured using a flow particle image analyzer (e.g., the FPIA-3000 particle analyzer available from SYSMEX Corporation of Kobe, Japan), and using the following equation:

$$\text{Circularity}=2\times(\pi\times\text{area})^{0.5}/\text{circumference} \qquad \text{Equation}$$

The circularity may be in the range of 0 to 1, and as the circularity approaches 1, the toner particle shape becomes more circular. Average circularity is obtained by calculating an average circularity of 3,000 toner particles.

<Evaluation on Geometric Size Distribution>

GSDv and GSDp, which are measures of geometric size distribution of toner particles, were measured by using Multisizer III (manufactured by Beckman Coulter), which is a Coulter counter, under the following conditions.

Electrolyte: ISOTON II

Aperture Tube: 100 um

Number of Particles: 30,000

Geometric size distribution of the toner is then divided into predetermined particle diameter ranges (channels). With respect to the respective particle diameter ranges (channels), the cumulative volume distribution of toner particles and the cumulative number distribution of toner particles are produced, wherein, in each of the cumulative volume and number distributions, the particle size in each distribution is increased in a direction from left to right. A cumulative particle diameter at 16% of the respective cumulative distributions is defined as a volume average diameter D16v and a number average particle diameter D16p. Likewise, a cumulative particle diameter at 84% of the respective cumulative distributions is defined as a volume average diameter D84v and a number average particle diameter D84p. GSDv and GSDp are calculated as follows.

$$GSDv=(D84v/D16v)^{0.5},$$

$$GSDp=(D84p/D16p)^{0.5}.$$

<X-ray Fluorescence Measurement>

An X-ray fluorescence measurement of each of the samples was performed using an energy dispersive X-ray spectrometer (EDX-720, available from SHIMADZU Corp. of Kyoto, Japan). An X-ray tube voltage was 50 kV, and the amounts of samples that were molded were 3 g±0.01 g. For each sample, the [Zn]/[Fe] ratio and the [Si]/[Fe] ratio were calculated using intensities (unit: cps/uA) measured using quantitative results obtained by the X-ray fluorescence measurement.

<Glass Transition Temperature and Melting Temperature Measurements>

A DSC curve was obtained under the following heat profile, with respect to 6 to 7 mg samples in powder shape under a nitrogen gas atmosphere, by using Perkin Elmer DSC6.

Primary Heating: from room temperature to 150° C. at a rate of 10° C./min, and maintained at a temperature of 150° C. for 1 minute Cooling: from 150° C. to 0° C. at a rate of −10° C./min and maintained at a temperature of 0° C. for 1 minute Secondary Heating: from 0° C. to 150° C. at a rate of 10° C./min Melting temperatures of the crystalline polyester resin and the releasing agent were determined based on a vertex of an endothermic peak showing a crystalline melting on the DSC curve. Also, glass transition temperatures thereof were determined based on a half Cp value of a shoulder type curve indicating a baseline shift showing a glass transition phenomenon.

<Evaluation on Fixability>

A belt-type fixing device which is the same fixing device as that is installed in Color Laser 660 laser printer available from Samsung Electronics Co., Ltd. was used to fix a test image under the following conditions.

Unfixed Image for Testing: 100% Pattern

Test Temperature: from 100° C. to 200° C. (at an interval of 10° C.)

Test Paper: 60 g paper sheet (X-9 available from Boise, Inc.), and 90 g paper sheet (Xerox Exclusive Available from Xerox Corp)

Fixing Speed: 160 mm/sec (Dwell Time): 0.08 sec.

The fixability of the fixed image was measured as follows: The optical density (OD) of the fixed image was measured, and then a 3M 810 tape was attached to the fixed image. A weight of 500 g was reciprocated thereon five times, and then the tape used was removed. Then, the OD of the fixed image was measured again.

(1) The fixability was evaluated according to following equation:

$$\text{Fixability}(\%)=(OD\text{ after peeling off the tape})/(OD\text{ before peeling off the tape})\times 100$$

A fixing temperature range in which the fixability was 90% or more is defined as the fusing latitude of toner.

(2) The minimum temperature in which the fixability was 90% or more without a cold-offset phenomenon is regarded as a minimum fusing temperature (MFT).

(3) The minimum temperature with a hot-offset phenomenon is regarded as a hot-offset temperature (HOT).

<Evaluation on Gloss>

Gloss (%) was measured using a glossmeter (micro-TRI-gloss available from BYK-Gardner) at a temperature of 160° C. at which the fixing device was used.

Measurement Angle: 60°:

Measurement Pattern: 100% Pattern.

<Evaluation on Charging Stability>

28.5 g of a carrier and 1.5 g of toner were loaded into a 60 mL glass container and then stirred with a tubular mixer. Then, an electric field separation method was used to measure a particle charge.

The charging stability was evaluated as follows.

○: A charging saturation curve with respect to a mixing hour is smooth and, after saturation charging, the change is negligible.

Δ: A charging saturation curve with respect to a mixing hour is slightly non-uniform, or after saturation charging, a small change occurred (maximum 30%).

X: Charging with respect to a mixing hour is not saturated, or after saturation charging, a significant change occurred.

<Evaluation on High-Temperature Storage Characteristics>

External additives were added to 100 g of toner and then the resultant toner was loaded into a developing unit which is the same developing unit as that is installed in Color Laser 660 laser printer and available from available from Samsung Electronics Co., Ltd and stored in a constant-temperature and constant-humidity oven under the following conditions while being packaged.

23° C., 55% RH (Relative Humidity), 2 Hours

=>40° C., 90% RH, 48 Hours

=>50° C., 80% RH, 48 Hours

=>40° C., 90% RH, 48 Hours

=>23° C., 55% RH, 6 Hours

After storing under the conditions described above, it was identified with the naked eye whether toner caking occurred in the developing unit, and a 100% pattern image was output to evaluate image defects.

Evaluation Criteria

○: Good image, no caking

Δ: Defected image, no caking

X: Caking occurred

Referring to Table 7 above, when a thermal properties change is not large after toner preparation according to suitable compatibility between the amorphous and crystalline polyester resins and the wax dispersion, i.e. when a glass transition temperature change between the amorphous polyester resin of the core layer and the toner, i.e., ΔTg, and a melting temperature change between the crystalline polyester resin and the toner, i.e., ΔTm, are not large (Examples 1-5), excellent high-temperature storage characteristics are maintained while obtaining low-temperature fixability (fixable at MFT under 120° C. or below). Moreover, anti-offset characteristics at high temperatures is excellent, and thus a high HOT is obtained. On the other hand, in the case of Comparative Example 1, wherein Tg is decreased by 24° C. after the toner preparation due to large compatibility between the amorphous and crystalline polyester resin and the wax dispersion, not only low-temperature fixability but also anti-offset characteristics were not satisfactory because crystallization of the crystalline polyester resin, i.e. the sharp melting characteristics disappears. In addition, due to the low Tg of the toner, high-temperature storage characteristics were not good. In Comparative Example 2, the melting temperature of the crystalline polyester resin is high, and thus satisfactory fixability is not obtained. In Comparative Example 3, because a melting temperature change ΔTm is 0, charging stability and gloss are bad.

Accordingly, according to the embodiments, toner satisfying low-temperature fixability, high gloss, and charging stability as well as high-temperature storage characteristics may be prepared by strictly controlling compatibility between the amorphous and crystalline polyester resins and releasing agent used for the core layer of the toner according to above conditions such that the melting temperature of the crystalline polyester resin and the Tg of the amorphous polyester resin do not remarkably change after the toner is prepared.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. Toner for developing an electrostatic image, comprising:

a core layer comprising a first binder resin, a colorant, and a releasing agent; and a shell layer covering the core layer and comprising a second binder resin, wherein the first binder resin comprises about 70 wt % or above of amorphous polyester resin and about 30 wt % or below of crystalline polyester resin, the second binder resin comprises an amorphous polyester resin, and a melting temperature (Tm(C)) of the crystalline polyester resin, a melting temperature (Tm(W)) of the releasing agent, and a melting point (Tm(T)) of the toner satisfy $-20° C. \leqq Tm(W)-Tm(C) \leqq 20° C.$, and $0° C. < Tm(C)-Tm(T) \leqq 10° C.$, wherein a glass transition temperature (Tg(A)) of the amorphous polyester resin of the core layer and a glass transition temperature Tg(T)) of the toner satisfy $0° C. < Tg(A)-Tg(T) \leqq 10° C.$, and wherein the melting temperature (Tm(C)) of the crystalline polyester resin and the melting point (Tm(W)) of the releasing agent satisfy $60° C. < Tm(C) < 100° C.$, and $60° C. < Tm(W) < 100° C.$

2. The toner of claim 1, wherein an acid value ($RA_{av}$) of the releasing agent, an acid value ($APE1_{av}$) of the amorphous polyester resin of the core layer, an acid value ($CPE_{av}$) of the crystalline polyester resin, and an acid value ($APE2_{av}$) of the amorphous polyester resin of the shell layer satisfy $RA_{av} \leqq APE1_{av} \leqq CPE_{av} \leqq APE2_{av}$, $CPE_{av}-APE1_{av} \leqq 5$ through 10, and $APE2_{av}-CPE_{av} \leqq 5$ through 10.

3. The toner of claim 1, wherein the toner comprises iron (Fe), silicon (Si), and zinc (Zn), the amounts of Si and Fe are each independently from about 3 to about 1000 ppm, a mole ratio (Si/Fe) of Si and Fe is from about 0.1 to about 5, and a [Si]/[Fe] ratio, and [Zn]/[Fe] ratio satisfy $0.0005 \leqq [Si]/[Fe] \leqq 0.05$, and $0.0005 \leqq [Zn]/[Fe] \leqq 0.5$ when [Si], [Zn], and [Fe] respectively denote intensities of Si, Zn, and Fe according to X-ray fluorescence spectrometry.

4. The toner of claim 1, wherein a volume average diameter of the toner is in the range from about 3 to about 9 μm.

5. The toner of claim 1, wherein an average circularity of the toner is in the range from about 0.940 to about 0.980.

6. The toner of claim 1, wherein a volume average geometric size distribution coefficient (GSDv) of the toner is about 1.3 or less, and a number average geometric size distribution coefficient (GSDp) of the toner is about 1.25 or less.

7. The toner of claim 1, wherein the releasing agent is one selected from the group consisting of a polyethylene-based wax, a polypropylene-based wax, a silicone wax, a paraffin-based wax, an ester-based wax, carnauba wax, and a metallocene wax.

* * * * *

UNITED STATES PATENT AND TRADEMARK OFFICE

CERTIFICATE OF CORRECTION

PATENT NO. : 8,431,308 B2
APPLICATION NO. : 12/923966
DATED : April 30, 2013
INVENTOR(S) : Kyeong Pang et al.

It is certified that error appears in the above-identified patent and that said Letters Patent is hereby corrected as shown below:

On the Title Page, Col. 1, Item (75) (Inventors), Line 4, Delete "Daeou" and insert --Daegu--, therefor.

Signed and Sealed this
Eighth Day of October, 2013

Teresa Stanek Rea

Teresa Stanek Rea
*Deputy Director of the United States Patent and Trademark Office*